US005322333A

United States Patent [19]

Norton, II et al.

[11] Patent Number: 5,322,333

[45] Date of Patent: Jun. 21, 1994

[54] CYLINDRICAL LOCKSET

[75] Inventors: George H. Norton, II, Higganum; James E. Robida, Cobalt, both of Conn.

[73] Assignee: Emhart Inc., Newark, Del.

[21] Appl. No.: 962,429

[22] Filed: Oct. 16, 1992

[51] Int. Cl.[5] ..... E05B 3/00

[52] U.S. Cl. ..... 292/336.3; 292/357; 292/DIG. 61

[58] Field of Search ..... 292/336.3, DIG. 60, 292/348, 357, DIG. 30, DIG. 53, DIG. 61, DIG. 64

[56] References Cited

U.S. PATENT DOCUMENTS

| | | | |
|---|---|---|---|
| 1,024,371 | 4/1912 | Soley . | |
| 1,633,183 | 6/1927 | Koeb et al. . | |
| 1,787,707 | 1/1931 | Sullivan | 292/348 |
| 2,423,206 | 7/1947 | Schlage . | |
| 2,470,770 | 5/1949 | Harvey . | |
| 2,470,771 | 5/1949 | Harvey . | |
| 2,538,647 | 1/1951 | Lickteig . | |
| 2,553,639 | 5/1951 | Dey . | |
| 2,615,744 | 10/1952 | Colonna . | |
| 2,701,160 | 2/1955 | Teich et al. | 292/336.3 |
| 2,727,773 | 12/1955 | Hagstrom . | |
| 2,729,485 | 1/1956 | Schlage . | |
| 2,804,334 | 8/1957 | Schlage et al. . | |
| 2,811,384 | 10/1957 | Schmid . | |
| 2,995,396 | 8/1961 | Russell et al. | 292/336.3 X |
| 3,000,659 | 9/1961 | Schlage et al. . | |
| 3,390,910 | 7/1968 | Kuchler . | |
| 4,065,165 | 12/1977 | Hamblin . | |
| 4,432,576 | 2/1984 | Wartian . | |
| 4,569,547 | 2/1986 | Fayerman et al. . | |
| 4,604,879 | 8/1986 | Neary et al. . | |
| 4,728,133 | 3/1988 | Valley . | |
| 4,869,083 | 9/1989 | DeMarseilles et al. | 292/357 X |
| 4,921,289 | 5/1990 | Shen | 292/336.3 |
| 4,976,480 | 12/1990 | Dixon et al. . | |
| 5,141,269 | 8/1992 | Hag et al. | 292/DIG. 60 X |
| 5,149,155 | 9/1992 | Caeti et al. | 292/336.3 |

*Primary Examiner*—Rodney M. Lindsey

[57] ABSTRACT

A cylinder lockset (30) includes a chassis assembly (72) with sleeves (80) and (81). A pair of liners (36) and (48) are mounted on sleeves (80) and (81), respectively, and facilitate attachment of chassis assembly (72) with a door (260). A pair of spring cassettes (38) are mounted on sleeves (80) and (82). A pair of levers (42) and (54) are mounted on the sleeves (80) and (82), respectively, and operate cassettes (38) directly for spring return of the levers upon release thereof. A pair of posts (388) and (390) are mounted on liner 48 and are formed with score locator lines (412), (414) and (416) to locate the liner relative to a housing (74) of assembly (72). Liner (36) is formed with four mounting holes (356), (358), (360) and (362) which facilitate use of the liner with either a left-hand or right-hand door mode.

8 Claims, 7 Drawing Sheets

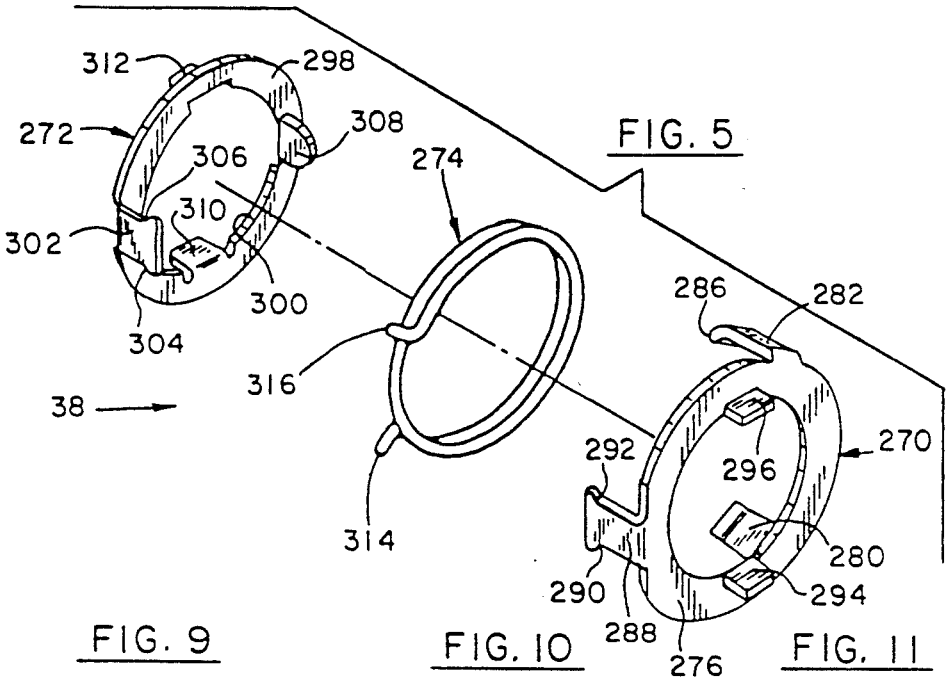
FIG. 5
FIG. 9
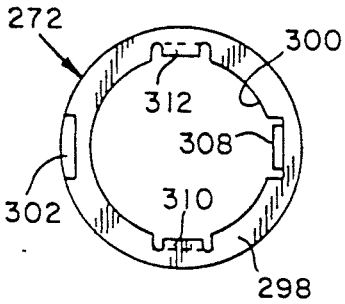
FIG. 10
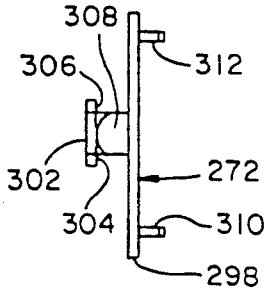
FIG. 11
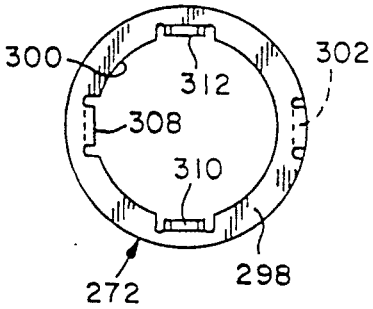
FIG. 6
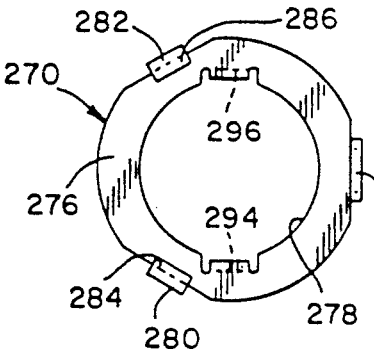
FIG. 7
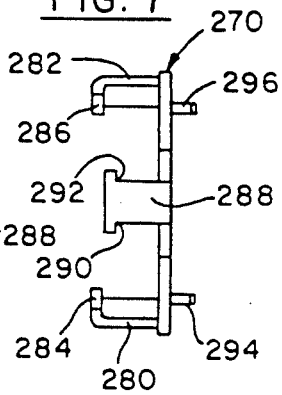
FIG. 8
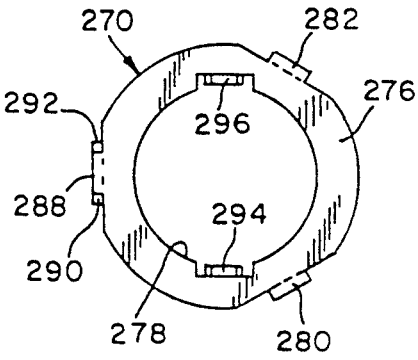

CYLINDRICAL LOCKSET

BACKGROUND OF THE INVENTION

This invention relates to a cylindrical lockset and particularly relates to a cylindrical lockset which includes a spring cassette actuated directly by an operator, such as a lever, associated with the lockset.

In some cylindrical locksets in use today, a spring cassette is used to return the lockset operator, such as a lever, to its home or non-operated position when it is released. Typically, the cassette is approximately the size of the rose of the lockset and a torsion spring contained within the cassette is only slightly smaller. The spring is formed with an inner free end from which overlapping convolutions of successively larger diameters is formed. The spring is further formed with an outer free end at the terminus of the outer most convolution thereof.

The cassette includes a dish-like receptor for the spring and a cover for containing the spring. An arbor is located centrally within the cassette for rotation independently thereof and is keyed to a rollback sleeve for rotation therewith. The inner end of the spring is attached to the arbor and the outer end of the spring is attached to the receptor which is fixedly mounted. An operator, such as a lever, is attached to the rollback sleeve and, when operated, rotates the sleeve. Through the keying structure of the sleeve, the arbor is rotated to tension the spring which provides the force to return the operator to its home position upon release thereof.

Spring cassettes of this type operate exceptionally well and are of sufficient bulk to respond to heavy duty demands. Even so, such cassettes and related facilities are relatively large and require specialized manufacturing and handling of several components which is directly related to cost. Further, the application of the tensioning force as applied to the spring by operation of the lever must be coupled through several components including the sleeve, the keying structure and the arbor.

Thus, there is a need for a lighter duty spring cassette with a more direct facility for tensioning the spring by operation of the lever.

Also, a door, on which a currently available cylindrical lockset is to be mounted, is prepared for assembly of the lockset therewith by forming various through-holes. For example, a central hole is formed through the door for receipt of the chassis. A pair of smaller holes are formed through the door adjacent the central hole for receipt of screws therethrough which are passed through holes in an inside liner and into internally threaded posts in an outside liner to pull together and hold the liners with the door. Typically, the pair of holes are formed in a diagonal pattern with an imaginary line passing diametrically across the central hole and through the pair of holes. When the hand of the door is to be changed, the door is prepared with the holes located adjacent the opposite side edge of the door with the outside of the door remaining as the outside. However, the pair of smaller holes in the new preparation are shifted by ninety degrees from the location of the previous pair of smaller holes. The inside liner which was used with the first above-described arrangement of holes has two holes formed therethrough to facilitate alignment of the liner holes with the first pair of smaller holes. Thus, this inside liner does not have holes which will align with the second pair of smaller holes and, therefore, is not functional or useful with the second set of holes which were prepared for a change of hand of the door. In this instance, the inside liner is dedicated for use with the first set of prepared door holes and another inside liner must be made which is dedicated for use with the second set of prepared holes.

Thus, there is a need for facility to allow for the use of a single inside liner regardless of the hand orientation of the door.

Typically, cylindrical locksets are assembled with doors of different thicknesses. For example, the thickness dimensions of three selected doors are one and three-eighths inches, one and three-quarters inches and two inches. Other thicknesses may be used.

In any event, an outside liner must be spaced from an associated inside liner on opposite sides of a chassis to define the door thickness. With current arrangements, the outside liner is mounted in assembly with the chassis and can be adjusted by an installer who uses a measuring scale to locate the outside liner with respect to a housing of the chassis. While this technique accomplishes the desired end result, it requires tedious manipulation of the inside liner by the installer while holding the measuring scale.

Thus, there is a need for facility to allow accurate location of the outside liner with respect to the chassis housing, preferably at the factory but also with allowance for on-site adjustment by the installer.

SUMMARY OF THE INVENTION

It is, therefore, an object of this invention to provide a cylindrical lockset with a relative light duty spring cassette which can be operated directly by the lockset operator.

Another object of this invention is to provide a cylindrical lockset having a universal inside liner which can be used with the lockset regardless of the hand of the door.

A further object of this invention is to provide a cylindrical lockset with facility for locating an outside liner for assembly of the lockset with a door of prescribed thickness.

With these and other objects in mind, this invention contemplates a cylindrical lockset mountable on a door which includes a latchbolt and a mechanism for moving the latchbolt between a latched position and an unlatched position. At least one sleeve extends from the mechanism for operating the mechanism upon rotation of the sleeve. An operator is mounted on the sleeve for facilitating selective rotation of the sleeve when the operator is moved from a non-operated position to an operated position. A spring cassette is mounted for direct actuation by the operator for development of a force to return the operator to the non-operated position when the operator is released.

This invention also contemplates a cylindrical lockset mountable on a door which includes a latchbolt and a mechanism for moving the latchbolt between a latched position and an unlatched position. At least one sleeve extends from the mechanism for operating the mechanism upon rotating of the sleeve. A liner is located about the sleeve and is formed with structural facility for assembly with the door regardless of the hand of the door.

This invention further contemplates a cylindrical lockset mountable on any door of several doors of different thicknesses which includes a latchbolt and a mechanism for moving the latchbolt between a latched position and an unlatched position. At least one sleeve extending from the mechanism for operating the mechanism upon rotation of the sleeve. Adjustable structure is mounted over the sleeve for movement relative to the mechanism and is positionable adjacent to a surface of the door for facilitating assembly of the lockset with the door. The adjustable structure is formed with facility to indicate the precise position of the adjustable structure relative to the mechanism to precisely locate the adjustable structure for accurate assembly with any door of the several doors of different thicknesses.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings:

FIG. 5 is an exploded perspective view of the spring cassette of FIG. 4;

FIG. 6 is a front or inside view of a spring actuator plate of the spring cassette of FIGS. 4 and 5 embodying certain principles of the invention;

FIG. 7 is a side view of the spring actuator plate of FIG. 6;

FIG. 8 is a rear or outside view of the spring actuator plate of FIG. 6;

FIG. 9 is a front or inside view of a spring stabilizer plate of the spring cassette of FIGS. 4 and 5 embodying certain principles of the invention;

FIG. 10 is a side view of the spring stabilizer plate of FIG. 9;

FIG. 11 is a rear or outside view of the spring stabilizer plate of FIG. 9;

DETAILED DESCRIPTION OF THE PREFERRED EMBODIMENT

Figures 1, 16:
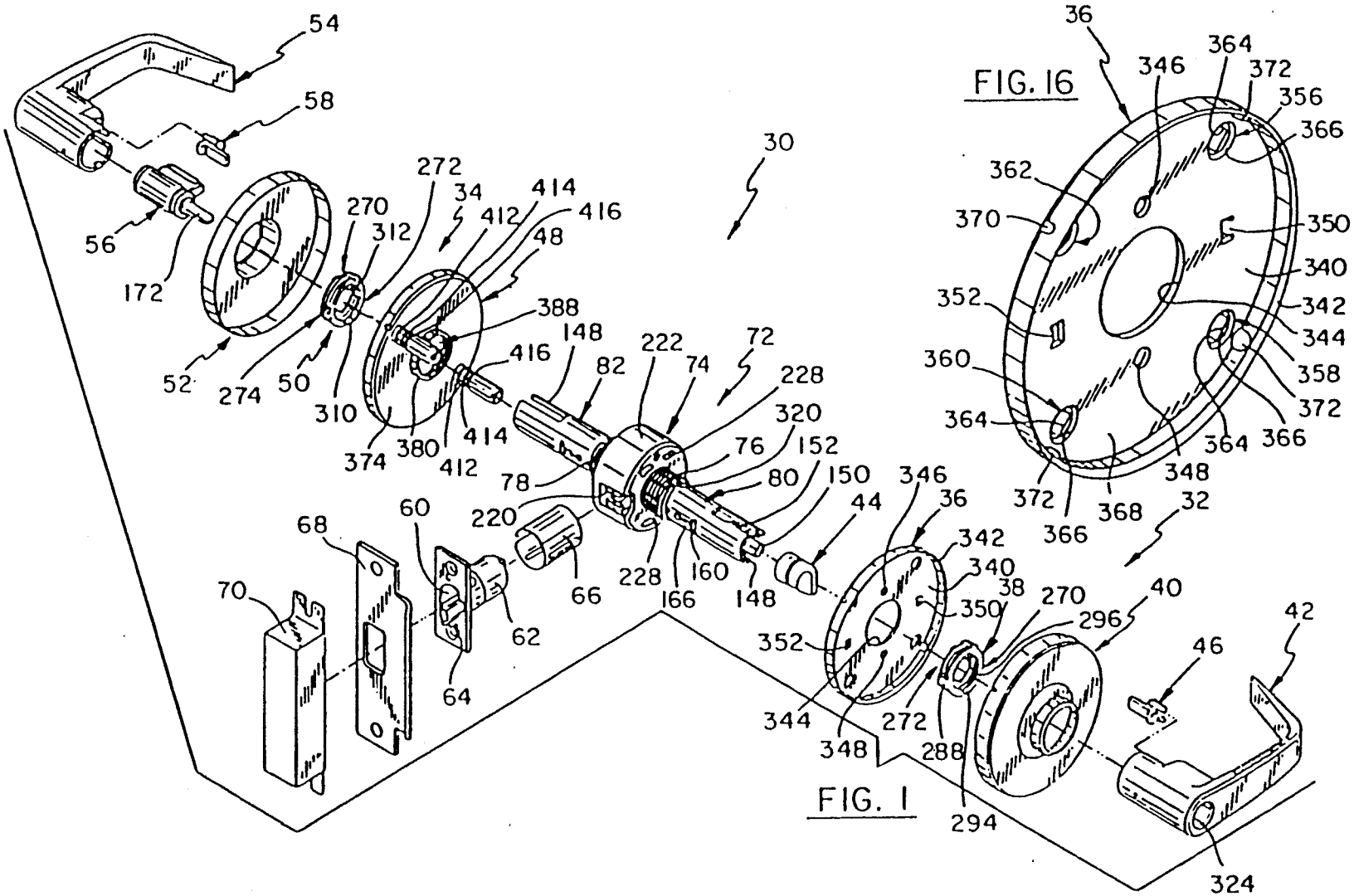
FIG. 1 is an exploded perspective view of a cylindrical lockset embodying certain principles of the invention.
FIG. 16 is a perspective view of the inside liner of FIG. 12.

As illustrated in FIG. 1, a cylindrical lockset 30 includes an inside subassembly 32 and an outside subassembly 34. The inside subassembly 32 includes an inside liner 36, a spring cassette 38, a rose 40, a lever 42, a turnbutton 44 and a lever insert 46. The outside subassembly 34 includes an outside liner 48, a spring cassette 50, a rose 52, a lever 54, a cylinder lock 56 and a lever insert 58.

Cylindrical lockset 30 further includes a latchbolt 60 mounted within a casing 62 which is staked or attached to a face plate 64. An auxiliary casing 66 is provided for larger mounting holes. A strike 68 and strike box 70 are also illustrated.

A chassis assembly 72 also forms a portion of cylindrical lockset 30 and includes a housing 74, a pair of threaded sleeves 76 and 78 extending from opposite sides of the housing. A pair of rollback sleeves 80 and 82 extend through threaded sleeves 76 and 78, respectively, and from housing 74.

Figure 3:
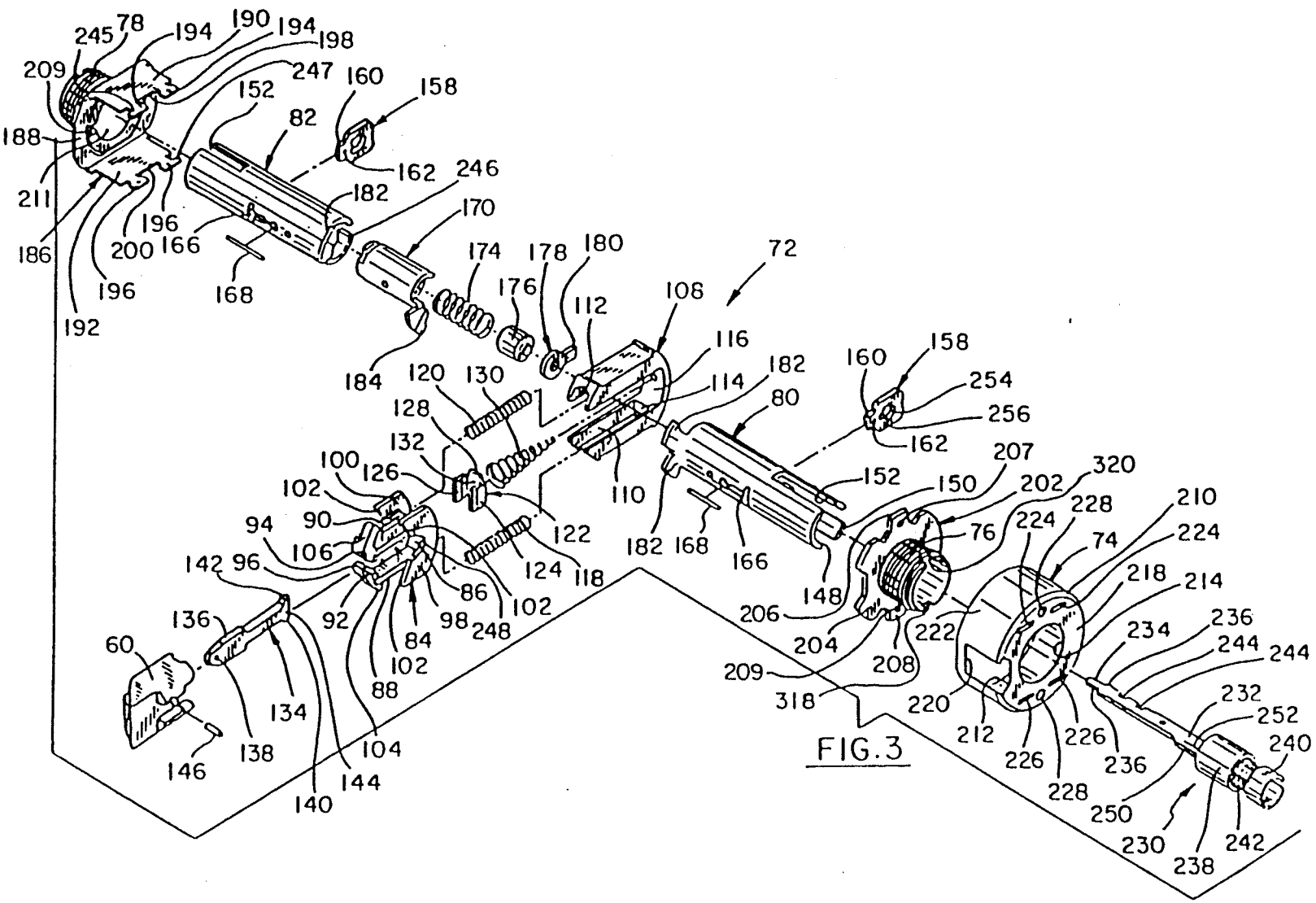
FIG. 3 is an exploded perspective view of a chassis assembly and latchbolt of the cylindrical lockset of FIG. 1.

Referring to FIG. 3, a retractor 84 is formed with a rear support 86 from which a pair of arms 88 and 90 extend. Arms 88 and 90 are formed at the free ends thereof with inwardly facing lips 92 and 94, respectively, which are separated to provide a space 96 therebetween. Retractor 84 is also formed with a pair of spaced sidewalls 98 and 100 having cam follower surfaces 102 formed thereon. A pair of walls 104 and 106 are located on outer surfaces of arms 88 and 90, respectively, adjacent the free ends thereof.

A retractor housing 108 is formed with lower rails 110 and upper rails 112 having associated rear walls 114 (one shown) all of which are integrally joined by a rear wall 116 of the retractor housing. A pair of springs 118 and 120 are captured between rear walls 114 of housing 108 and walls 104 and 106, respectively, of retractor 84 when the retractor is moved into assembly with the housing. Also, when retractor 84 is assembled with housing 108, arms 88 and 90 are located adjacent rails 110 and 112, respectively. Further, sidewalls 98 and 100 are located outside of the sides of rails 110 and 112.

A linkage bar catch 122 is formed with a pair of forwardly directed legs 124 and 126, an upwardly directed upper tab 128 and a comparable downwardly directed lower tab (not shown). A spring 130 is attached at one end thereof to a rear wall 132 of catch 122 and extends rearwardly thereof. The other end of spring 130 is attached to rear wall 116 of retractor housing 108. Catch 122 is positioned so that legs 124 and 126 extend through rear support 86 of retractor 84 when the catch and retractor are assembled within housing 108. However, tab 128 and lower tab of catch 122 preclude full movement of the catch fully into the space between arms 88 and 90 of retractor 84.

A link 134 is formed with a head end 136 having a hole 138 formed therethrough and cross arms 140 and 142 at a rear end 144 thereof. Head end 136 is assembled with latchbolt 60 by use of a pin 146 which extends through hole 138 and a hole (not shown) formed in the latchbolt. Cross arms 140 and 142 are located between arms 88 and 90, respectively, of retractor 84 and are retained with the retractor by lips 92 and 94, respectively. In this manner, retractor 84 is coupled to latchbolt 60 so that the latchbolt moves upon movement of the retractor.

Rollback sleeves 80 and 82 are each formed with three slots 148,150 and 152 at the outboard ends of the sleeves. Slots 148 and 152 of each of the sleeves 80 and 82 are diametrically opposed to each other while slot 150 is located approximately ninety degrees from slots 148 and 152 at one side of the sleeves.

A catch plate 158 is formed with a reduced end 160 which has a small through hole 162. Plate 158 is positioned through a slot (not shown) formed in the side of sleeve 80 so that end 160 protrudes slightly out of a T-shaped slot 166 on the other side of the sleeve. A pin 168 is positioned through the T-shaped slot 166 and the small hole 162 of plate 158 and serves to retain the plate with sleeve 80 in such a manner that end 160 extends in biased fashion through the T-shaped slot. This provides a spring-biased catch for lever 42 (FIG. 1) to retain the lever on sleeve 80. An identical catch arrangement is provided with respect to sleeve 82 by use of catch plate 158 and pin 168.

An auxiliary rollback sleeve 170 is arranged to be positioned within sleeve 82. As situated in FIG. 3, sleeve 170 is formed with a face (not shown) in the end of the sleeve which is facing the adjacent end of sleeve 82. A cross-slot (not shown) is formed in the face of sleeve 170 for eventual receipt of a tailpiece 172 (FIG. 1) of lock 56. A spring 174, an insert 176 and a locking dog 178 with an ear 180 are arranged for insertion into sleeve 170.

Sleeve 80 is formed with a set of rollback cams 182. Sleeve 82 is formed with a rollback cam 183 which is aligned with a rollback cam 184 formed on sleeve 170. Cams 182 and 184 are eventually situated to engage cam follower surfaces 102 to move retractor 84 rearwardly upon rotation of sleeve 80, 82 or 170.

A case 186 includes threaded sleeve 78 which is staked or attached to a plate 188 having inwardly turned sections 190 and 192 with a pair of upper tabs 194 and a pair of lower tabs 196 formed on the inboard edges of the sections 190 and 192, respectively. A space 198 is formed between upper tabs 194 and a space 200 is formed between lower tabs 196. A cap 202 includes threaded sleeve 76 which is staked or attached to a plate 204 having an upper tab 206 and a lower tab 208 having threaded through holes 207 and 209, respectively. A pair of diametrically opposed, horizontally disposed grooves 209 (one shown) are formed in an opening 211 of sleeve 78.

Housing 74 is formed by a cylindrical shell 210 which is open on one side 212 and is formed with a central opening 214 in a wall 218 on the other side thereof. An opening 220 is formed in a sidewall 222 of shell 210. A pair of upper holes 224 and a pair of lower holes 226 are formed in wall 218. Also, a pair of through holes 228 are formed in wall 218.

A linkage assembly 230 includes a bar 232 formed with a reduced end 234 and shoulders 236 at one end thereof. The opposite end of assembly 230 is positioned through a fixed cylindrical shell 238 and is staked or attached to turnbutton holder 240 which is biased away from the shell by a spring 242. A pair of spaced notches 244 are formed along one edge of bar 232 near shoulders 236. It is noted that holder 240 is a receptacle for either a turnbutton, such as turnbutton 44 (FIG. 1), or a push button (not shown).

In assembly of chassis assembly 72, retractor 84, catch 122 and springs 118, 120 and 130 are assembled with retractor housing 108. Spring 174, insert 176 and locking dog 178 are assembled within auxiliary sleeve 170 which, in turn, is assembled within sleeve 82 whereby ear 180 is positioned for selective insertion into a slot 246 of sleeve 82. Case 186 is then placed over sleeve 82 whereby one of the grooves 209 of the case align with slot 246 on the radially outboard side of groove 209. Ear 180 extend radially outwardly sufficiently to provide for selective positioning of the ear into groove 209 and slot 246. It is noted that the mouth of slot 246 is located outboard of the inboard end of groove 209 so that ear 180 can be located in the groove but must be moved further outboard to also locate the ear in the slot.

Case 186 and the other elements assembled therewith to locate the inboard ends of sleeves 82 and 170 adjacent a side of retractor housing 108. In this position, cams 182 and 184 of sleeves 82 and 170, respectively, are located adjacent associated ones of the cam follower surfaces 102. Also, sections 190 and 192 are located above and below, respectively, retractor housing 108.

Cap 202 is then positioned onto sleeve 80 and, together with the sleeve, is moved to a position at one side of retractor housing 108 so that cams 182 are located adjacent associated cam follower surfaces 102. Further, tabs 206 and 208 locate within spaces 198 and 200, respectively, to preclude rotation of the cap 202 relative to case 186.

Housing 74 is then positioned over sleeve 80 with tabs 194 and 196 be moved through holes 224 and 226, respectively. Thereafter, fingers 245 and 247 of one of each of the sets of tabs 194 and 196, respectively, are twisted to facilitate securance of case 186 and cap 202 with housing 74 and to facilitate securance of the elements between the case and cap in the arrangement described above.

Reduced end 234 and bar 232 are inserted into opening 214 of housing 74 and into sleeve 80. Reduced end 234 and shoulders 236 are further inserted laterally through retractor 84 on the outboard side of arcuate walls 248 (one shown) of sidewalls 98 and 100. Eventually, reduced end 234 is inserted through an opening in dog 178 until shoulders 236 engage the dog.

Bar 232 is formed with a pair of spring fingers 250 and 252 which are biased apart at the outboard ends thereof to hold the shell 238 and spring 242 between the free ends of the spring fingers and holder 240. When bar 232 is moved through sleeve 80 as described above, the bar is moved through an opening 254 of catch plate 158. A notch 256 is formed in the wall of opening 254 to allow the spring fingers 250 and 252 of bar 232 to compress together as the fingers move through the notch. As the fingers 250 and 252 clear the notch 256, the fingers are biased apart as noted above and bar 232 is now captured within sleeve 80 and partially into sleeve 82 for engagement with dog 178.

In order to lock the lockset 30, and if a push button is used, bar 232 is pushed inwardly thereby pushing dog 178 away from retractor housing 108. In this manner, ear 180 moves further into groove 209 of sleeve 78 and now moves into slot 246 of sleeve 82. Any attempt to turn sleeve 82 by use of lever 54 is prevented by virtue of ear 180 being located in fixed groove 209 and slot 246 of sleeve 82.

When bar 232 is positioned to lock the lockset 30, notches 244 of the bar are moved to a position adjacent legs 124 and 126 whereby spring 130 urges the legs into the notches which, in effect, secures the bar in the locked position.

If sleeve 80 is rotated by use of lever 42 (FIG. 1), for example, the sleeve will rotate to move retractor 84 further into housing 108 to retract latchbolt 60. As retractor 84 is moved, catch 122 is also moved further into housing 108 whereby legs 124 and 126 are moved out of notches 244 of bar 232. Under the biasing action of spring 242, bar 232 now moves in an outboard direction to move notches 244 from alignment with legs 124 and 126. When lever 42 is released, legs 124 and 126 come to rest against the edge of bar 232 and the bar is no longer confined to the locked position. Also, when bar 232 is moved in the outboard direction, shoulders 236 are moved away from dog 178 whereby the dog moves under the biasing action of spring 174 and ear 180 moves out of slot 246 of sleeve 82. Sleeve 82 can now be rotated by lever 54.

When lockset 30 is in the locked condition as described above, a key (not shown) may be inserted into cylinder lock 56 (FIG. 1) to turn tailpiece 172 and thereby rotate auxiliary sleeve 170. With rotation of sleeve 170, cam 184 urges retractor 84 further into housing which, in turn, moves catch 122 further into the housing. Release from the locked condition then follows the same process as described above.

If a turnbutton, such as turnbutton 44, is used to lock the lockset 30, bar 232 is initially located so that notches 244 appear on top of the bar. Turnbutton 44 is pushed inwardly to push bar 232 inwardly whereby notches 244 are moved into alignment with legs 124 and 126 of catch 122. However, notches 244 are directed upwardly and have no effect on the positioning of catch 122 in this orientation. As bar 232 is pushed inwardly, dog 178 is moved into the locking position as described above. Turnbutton 44 is then turned ninety degrees whereby bar 232 is turned ninety degrees whereby legs 124 and 126 of catch 122 can now move into notches 244 to hold the bar in the locked mode.

Figure 2:
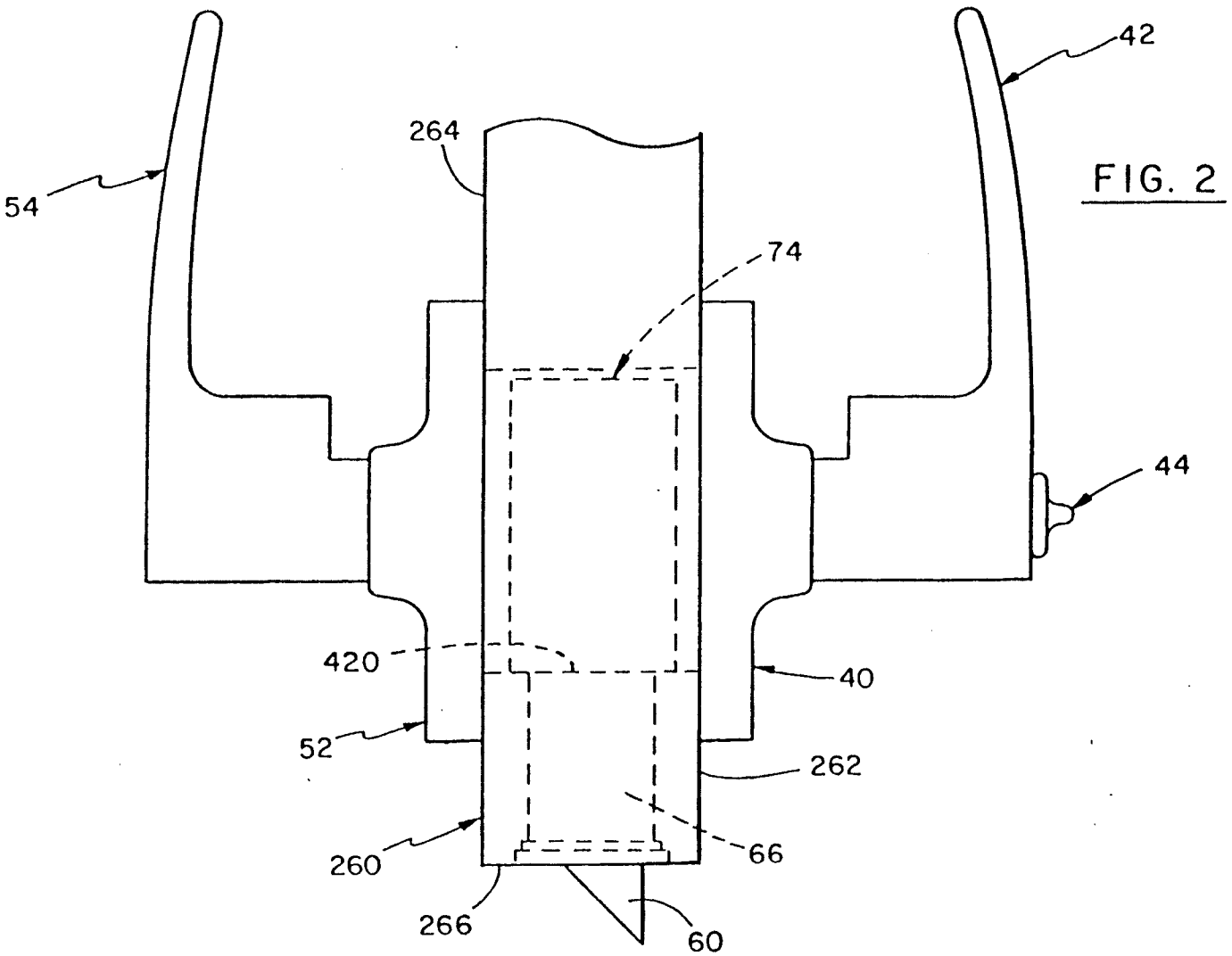
FIG. 2 is a plan view of the cylindrical lockset of FIG. 1 in assembly with a door.

Referring to FIG. 2, lockset 30 is assembled with a door 260 wherein lever 42, rose 40 and turnbutton 44 are located on an inside surface 262 of the door and lever 54 and rose 52 are located on an outside surface 264 of the door. Also latchbolt 60 extends outwardly from an edge 266 of door 260.

Figure 4:
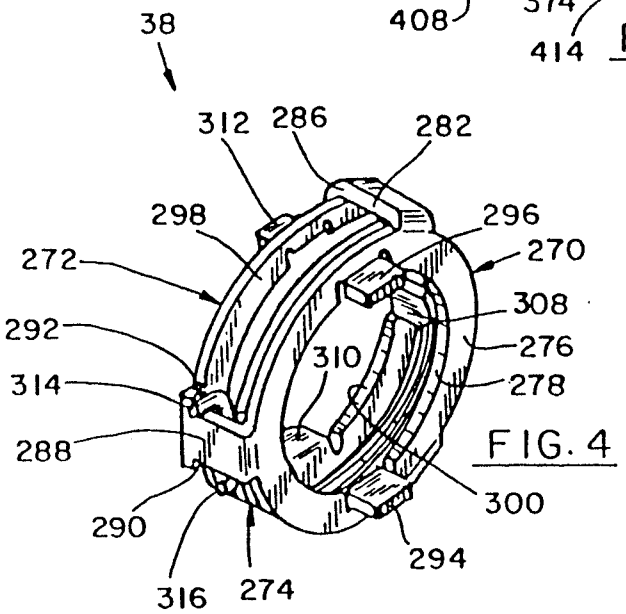
FIG. 4 is a perspective view of a spring cassette embodying certain principles of the invention.
Figure 13:
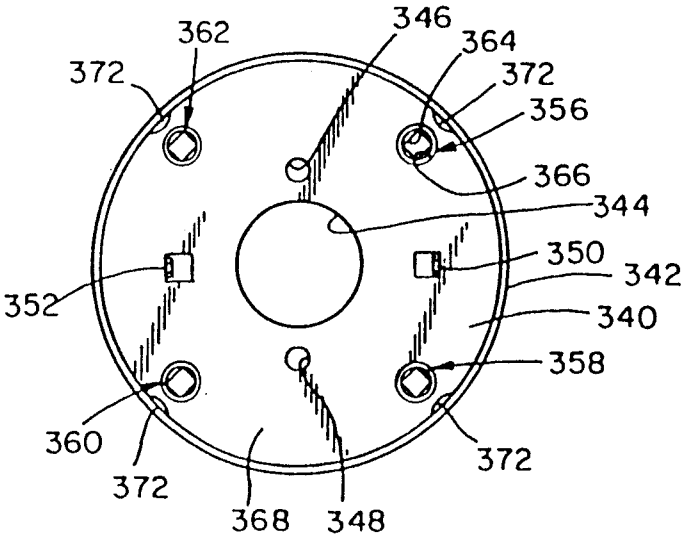
FIG. 13 is a rear or inside view of the inside liner of FIG. 12.

Referring to FIGS. 4 and 5, spring cassette 38 includes a spring actuator plate 270, a spring stabilizer plate 272 and a torsion spring 274 sandwiched therebetween. As shown in FIGS. 4, 5, 6, 7 and 8, actuator plate 270 is formed by a flat ring 276 having a central opening 278. A pair of fingers 280 and 282 extend for an equal distance in an axial inboard direction from spaced peripheral portions of ring 276. Finger 280 is formed at its free end with an inwardly turned section 284 while finger 282 is formed at its free end with an inwardly turned section 286. A third finger 288 extends in an axial direction from another peripheral portion of ring 276 for a distance slightly less than the extended distance of fingers 280 and 282. The outer free end of finger 288 is formed in a "T" shape which results in the formation of shoulders 290 and 292. A pair of tabs 294 and 296 are formed on the wall of central opening 278 and extend in an outboard axial direction.

Stabilizer plate 272 is also formed by a flat ring 298 having a central opening 300. A first finger 302 extends from an outer peripheral portion of ring 298 in an inboard axial direction. The outer free end of finger 302 is formed in a "T" shape which results in the formation of shoulders 304 and 306. Plate 272 is also formed with a second finger 308 which extends from the wall of opening 300 in an inboard axial direction and is diametrically opposite finger 302. A pair of tabs 310 and 312 are also formed on the wall of central opening 300 and extend in an outboard axial direction.

Torsion spring 274 is formed in two convolutions with free ends 314 and 316 thereof extending generally radially outwardly and are spaced apart.

In assembly, plates 270 and 272 are assembled with spring 274 therebetween and so that "T" shaped finger 288 overlaps "T" shaped finger 302. Spring 274 is pretensioned by moving ends 314 and 316 towards and past each other a distance sufficient to locate the ends on opposite sides of the overlapped fingers 288 and 302. Tab 308 of plate 272 provides an inner constraint for spring 274 to establish an inward radial limit for the spring. Finger 302 of plate 272 and fingers 280 and 282 of plate 270 establish an outer radial limit for spring 274. End 314 of spring 274 is confined in an axial direction of cassette 38 between shoulder 292 of plate 276 and shoulder 306 of plate 272. End 316 of spring 274 is confined in an axial direction of cassette 38 between shoulder 290 of plate 276 and shoulder 304 of plate 298. Further, inwardly turned sections 284 and 286 of fingers 280 and 282, respectively, of plate 270 locate around plate 272 and serve to hold the plates together with spring 274 assembled therebetween.

Cassette 38 is assembled onto sleeve 80, for example, preferably with tabs 310 and 312 being directed toward housing 74 during assembly thereof. Tabs 310 and 312 are aligned with a pair of notches 318 and 320 formed in diametrically opposite sides of the outboard end of sleeve 76 as viewed in FIG. 3. With this alignment, finger 308 of plate 272 is positioned to depress end 162 of plate 158 and thereby allow cassette 38 to move over the depressed end with relative ease. Eventually, tabs 310 and 312 are moved into notches 318 and 320, respectively, to thereby attach cassette 38 to a fixed element of lockset 30. In the arrangement, plate 272 is prevented from rotation.

Figure 21:
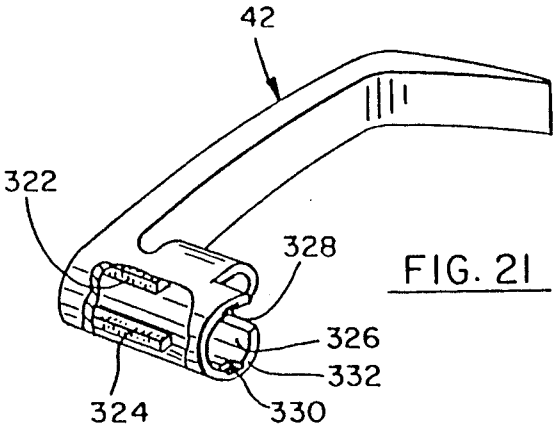
FIG. 21 is a perspective view of a lever formed with structure for assembly with the spring cassette of FIGS. 4 and 5 in accordance with certain principles of the invention.

Referring to FIG. 21, lever 42 is formed with a pair vertically aligned spaced ribs 322 and 324 within a cylindrical opening 326. A pair of notches 328 and 330 are formed in an inboard edge 332 of lever 42 at the mouth of opening 326. The notches 328 and 330 are vertically aligned. Following assembly of liner 36, cassette 38 and rose 40 onto sleeve 80, lever 42 is positioned onto the outboard end of the sleeve so that ribs 322 and 324 move into slots 148 and 152, respectively, of the sleeve. In this manner, lever 42 is coupled to sleeve 80 to facilitate rotation of the sleeve upon operation of the lever.

As lever 42 is positioned on sleeve 80, notches 328 and 330 move over and encompass tabs 294 and 296, respectively, of actuator plate 270 to thereby directly couple the plate to the lever for movement therewith. Cassette 38 is mounted on sleeve 80 as noted above in such a manner that the sleeve rotates independently of the cassette and does not impart any force for moving any part of the cassette.

As lever 42 is operated, that is moved from a non-operated or home position to an operated position, actuator plate 270 is rotated about sleeve 80 through the direct coupling between the lever and the plate. As plate 270 is rotated, finger 288 of the plate is moved in one direction or the other depending upon the direction of operation of lever 42. During rotation of plate 270, stabilizer plate 272 is held in a fixed or stationary condition so that plate 270 rotates relative to plate 272. Movement of finger 288 results in movement of one or the other of ends 314 and 316 of spring 274 to further tension the spring. As spring 274 is tensioned energy is stored in the spring so that, upon release of lever 42, a force is applied by spring 274 against finger 288 whereby plate 270 directly moves and returns the lever to its home position.

Cassette 38 is lightweight, easy to assemble and relatively low in cost. Further, due to its unique structure, cassette 38 can be used with either the inside subassembly 32 or the outside subassembly 34. Also, cassette 38 can be used in either a left hand or a right hand mode without the necessity of disassembly and reassembly of components of the cassette.

The above-described preferred technique for assembling cassette 38 onto sleeve 80 includes the positioning tabs 310 and 312 of plate 272 into notches 318 and 320, respectively, of sleeve 76. However, cassette 38 could be assembled on sleeve 80 in such a manner that tabs 294 and 296 of plate 270 would be positioned into notches 318 and 320, respectively, of sleeve 76 and still function as a spring-return cassette. In this instance, plate 272 would be coupled directly to lever 42 and finger 302 of the plate would move either of the ends 314 or 316 of spring 274 upon operation of the lever.

Thus, as described above, cassette 38 is a universal cassette with respect to its manner of assembly and operation.

Another cassette 38 is assembled with sleeve 82 of the outside subassembly 34 in the same manner as described above with respect to the inside subassembly 32. For example, tabs 310 and 312 of plate 272 would be assembled in notches in sleeve 78 in the same manner as assembly of the tabs in notches 318 and 320 of sleeve 76. Further, tabs 294 and 296 of plate 270 would be assembled in notches in lever 54 in the same manner that the tabs are assembled with notches 328 and 330, respectively, of lever 42.

Figure 14:
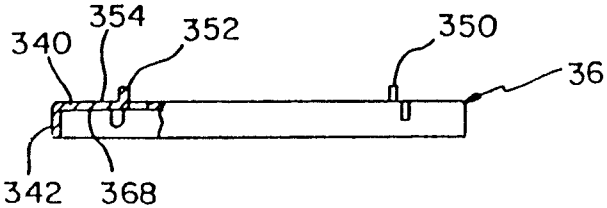
FIG. 14 is a side view of the inside liner of FIG. 12.

As shown in FIGS. 1, 12, 13 and 16, liner 36 is formed in a dish-like configuration and includes a base 340 and a rim 342 formed integrally therewith. Base 340 is formed with a central opening 344 and a pair of small through holes 346 and 348 which are located vertically and slightly above and below, respectively, the central opening. A pair of tabs 350 and 352 are formed in base 340 and are located horizontally to the right and left, respectively, of central opening 344. Tabs 350 and 352 extend outwardly from an outer face 354 of base 340 as shown particularly in FIG. 14.

Figure 15:
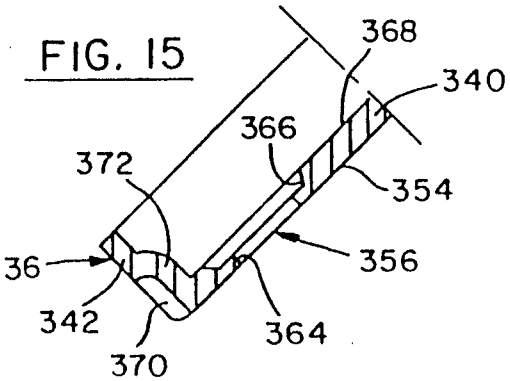
FIG. 15 is a partial sectional view showing structure of a through-hole formed in the inside liner of FIG. 12.
Figure 12:
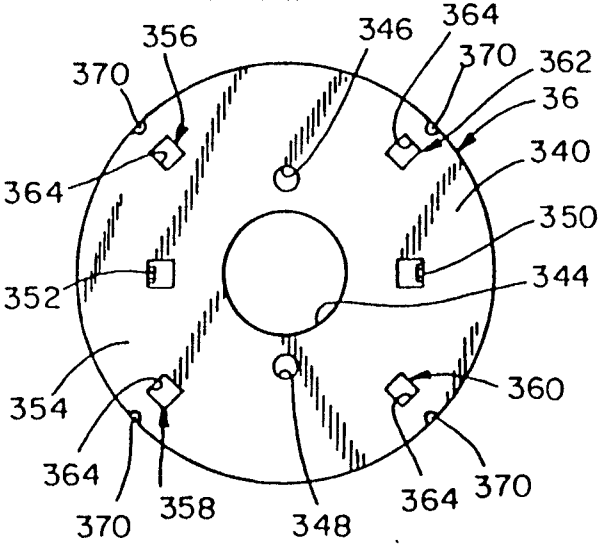
FIG. 12 is a front or outside view of an inside liner embodying certain principles of the invention.

Four holes 356, 358, 360 and 362 are formed through base 340 and are equally spaced on forty-five degrees diagonals with respect to central opening 344. As shown in FIG. 15, each of the holes 356, 358,360 and 362 are formed with a square portion 364 contiguous with outer face 354 and a chamfer portion 366 which is contiguous with an inner face 368 of base 340 and communicates with the square portion. Four dimples 370 are formed in rim 342 on the outer surface thereof which results in the formation of projections 372 on the inner surface of the rim adjacent each of the holes 356, 358, 360 and 362.

Figure 18:
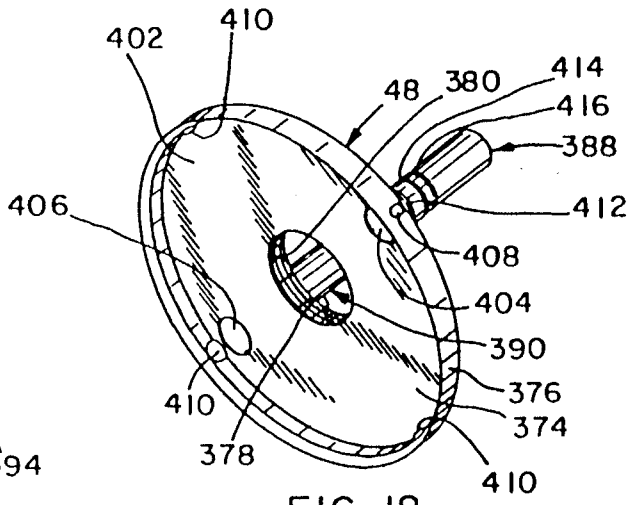
FIG. 18 is a perspective view showing an assembly of the outside liner with the posts of FIG. 17.
Figure 17:
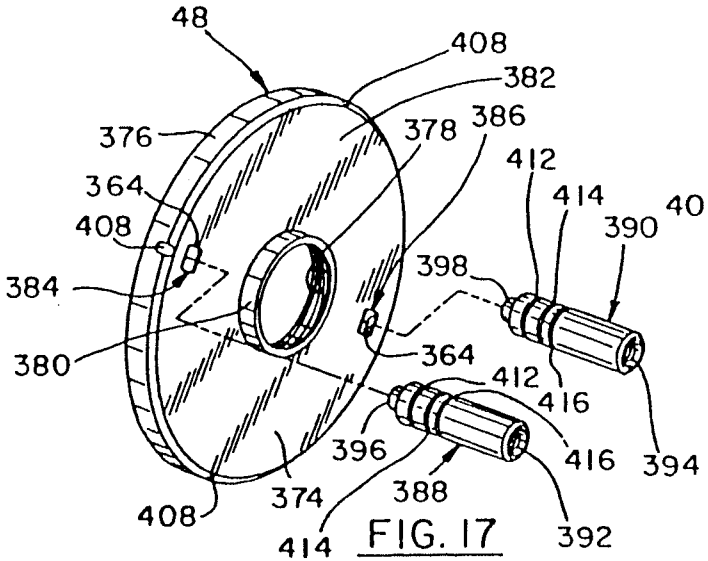
FIG. 17 is a perspective view of an outside liner positioned for assembly with internally threaded posts each having three scored locator lines in accordance with certain principles of the invention.

Referring to FIGS. 1, 17 and 18, liner 48 is also formed in a dish-like configuration and includes a base 374 and a rim 376 formed integrally therewith. Base 374 is formed with a central opening 378 which extends through a hub 380 which projects from an outer face 382 of the base. As noted above, central opening 378 extends through base 374 and hub 380 and is internally threaded.

Liner 48 is formed with a pair of holes 384 and 386 which extend through base 374 and which are formed in the same manner as holes 356, 358, 360 and 362. For example, referring to FIGS. 15 and 17, holes 384 and 386 (FIG. 17) are identical to hole 356 (FIG. 15) and are formed with square portion 364 and chamfer portion 366. Holes 384 and 386 are located on a diagonal with respect to central opening 378 with hole 384 being located to the upper left of the central opening and hole 386 being located to the lower right of the central opening.

As shown in FIG. 17, a pair of posts 388 and 390 are formed with axial openings 392 and 394, respectively, at one end thereof. Each of the openings 392 and 394 are threaded and extend only partially through the length of the posts 388 and 390, respectively. The posts 388 and 390 are formed at the other end thereof with solid, circular extensions 396 and 398, respectively, each having a diameter smaller than the diameter of the posts. The diameter of each of the extensions 396 and 398 is such that the extensions can be inserted through holes 384 and 386, respectively, from outer face 382 of base 374 with the outboard end of the extensions extending beyond an inner face 402 of the base. The extended end of each of the extensions 396 and 398 is then riveted or staked so that the material of the extensions will be reshaped within holes 384 and 386, respectively. In this manner, the extensions 396 and 398 are reshaped to conform generally to the shape of square portion 364 and chamfer portion 366 (FIG. 15) of holes 384 and 386. The outer ends of the extensions are formed with shallow convex heads 404 and 406 which are nearly flush with inner face 402 of base 374.

Liner 48 is formed with dimples 408 on the outer surface of rim 376 which results in the formation of projections 410 on the inner surface of the rim.

Each of the posts 388 and 390 is formed with a first circumferential score line 412, a second circumferential score line 414 and a third circumferential score line 416.

Typically, in the industry, doors are available in a variety of thicknesses such as, for example, thicknesses of one and three-eighths inches, one and three-quarters inches and two inches.

In preparing a door, such as door 260, for assembly of lockset 30 therewith, a central hole 420 (FIG. 2) is formed through the door for receipt of chassis assembly 72. A pair of notches (not shown) may be preformed in door 260 for receipt of tabs 350 and 352 of liner 36 to provide an anti-rotational feature for lockset 30. For wooded doors, the tabs may form the door notches upon assembly. A pair of larger holes (not shown) are formed on a diagonal with respect to hole 420 and are situated for receipt of posts 388 and 390 in the orientation illustrated in FIG. 1.

In the past, posts 388 and 390 were not formed with score lines 412, 414 and 416. During assembly of lockset 30, which does not include score lines 412, 414 and 416, with door 260, threaded opening 378 is threadedly mounted on sleeve 78 of chassis assembly 72. In this assembly, posts 388 and 390, which are not formed with score lines 412, 414 and 416, overlap housing 74. Latchbolt 60 with casing 62 and link 134 are inserted through a hole (not shown) formed in edge 266 of door 260.

Sleeve 80 is moved through hole 420 from the outside surface of door 260 until housing 74 is located within the hole. At this time, posts 388 and 390 are inserted into the pair of larger diagonal holes formed in door 260. Also, link 134 is coupled to retractor 84 as chassis assembly 72 is moved into hole 420. Liner 36 is positioned over sleeve 80 so that diagonal holes 362 and 358 are aligned with the pair of diagonal large holes formed through door 260 and containing posts 388 and 390. A pair of screws (not shown) are moved through holes 362 and 358 of liner 36 and are threadedly mounted in threaded openings 392 and 394, respectively, of posts 388 and 390. Tightening of the screws draws liners 36 and 48 against respective surfaces of door 260. A pair of screws (not shown) are then moved through holes 346 and 348 of liner 36, through holes 228 of housing 74 and are threadedly mounted into threaded holes 207 and 209 of cap 202.

To complete the assembly, cassette 38, rose 40 and lever 42, within insert 46, are mounted on sleeve 80 as previously noted for the inside subassembly 32. For the outside subassembly 34, cassette 38 and rose 52 are positioned on sleeve 82 and lock 56 is positioned within lever 54. Insert 58 is then assembled with lever 54. Lever 54 with assembled lock 56 is then positioned onto sleeve 82 as previously described.

Prior to the assembly of chassis assembly 72 and liner 48 with door 260, liner 48 must be adjusted on sleeve 78 for the thickness of the door. Typically, this is accomplished at the installation site with a measuring scale and, to some extent, with a trial and error process.

As described above, posts 388 and 390 are formed with score lines 412, 414 and 416 on the periphery of thereof. Each of lines 412, 414 and 416 are precisely located on posts 388 and 398 and are representative of the above-noted three door thicknesses, that is one and three-eighths inches, one and three-quarters inches and two inches, respectively.

Figure 19:
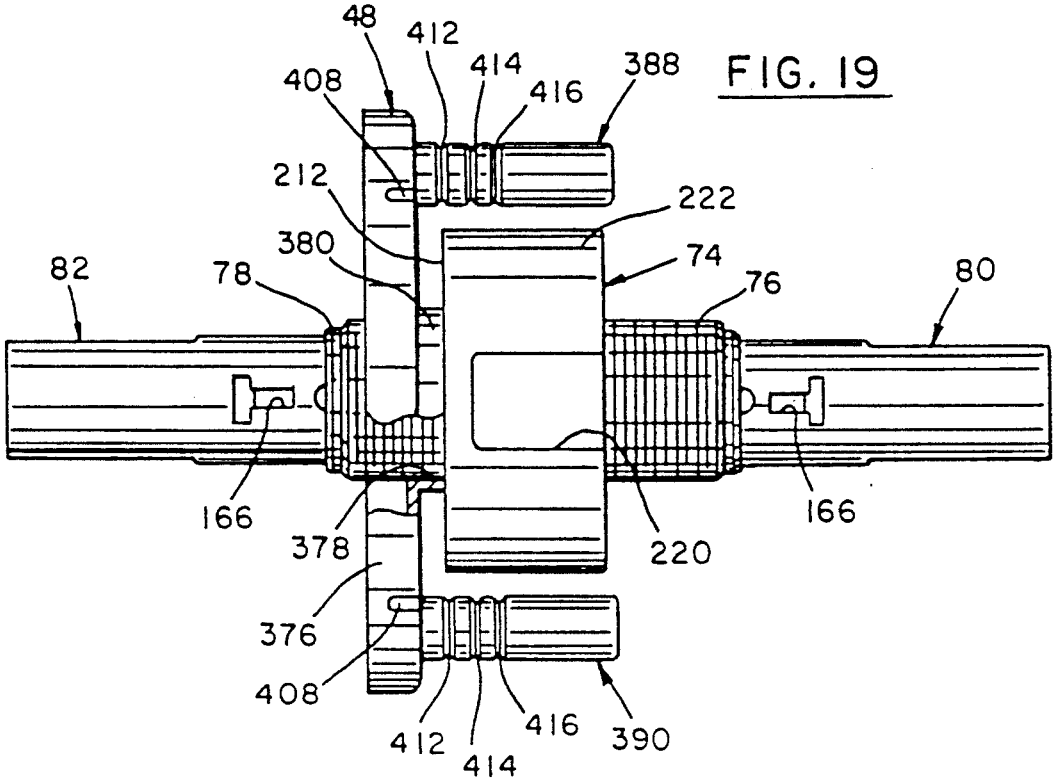
FIG. 19 is a side view of a chassis assembly with the outside liner and posts of FIG. 17 in position so that one scored line is aligned with a housing of the chassis assembly in accordance with certain principles of the invention.
Figure 20:
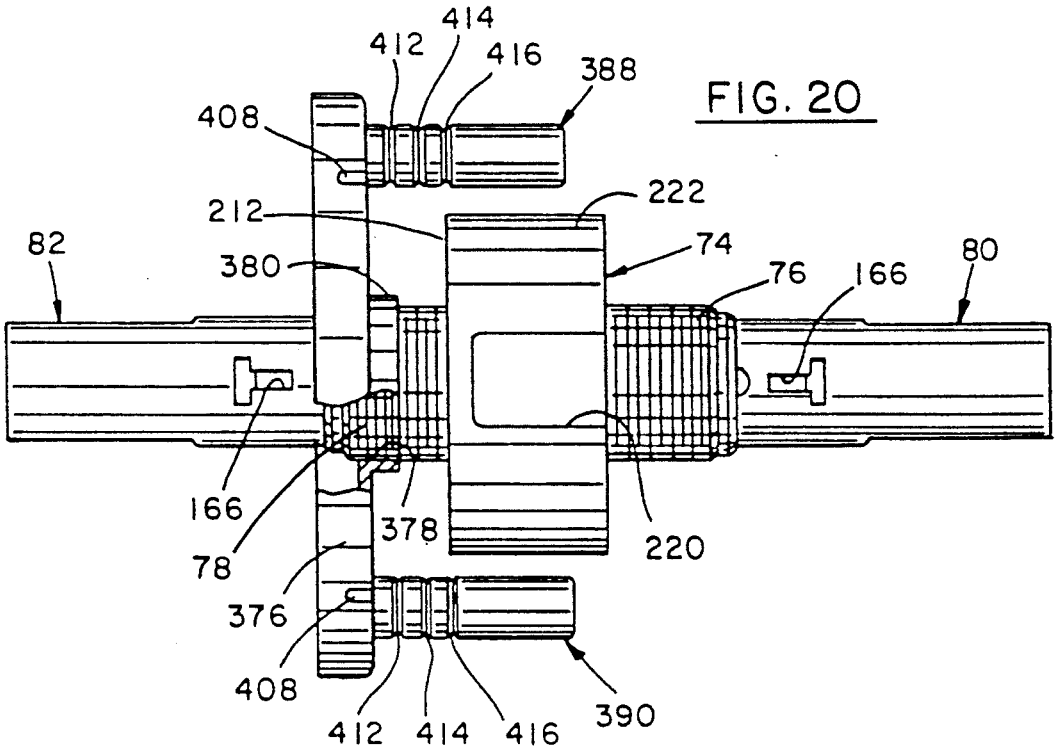
FIG. 20 is a side view of the elements of FIG. 19 showing another scored line aligned with the housing in accordance with the principles of the invention.

As shown in FIGS. 19 and 20, liner 48 is mounted on sleeve 78 and can be threadedly adjusted with respect to open side 212 of housing 74. Lines 412, 414 and 416 have been precisely located so that, when lines 412 of posts 388 and 390 are aligned with side 212 of housing 74, liner 48 is positioned with respect to the housing for assembly with a door having a thickness of one and three-eighths inches. Liner 48 can also be adjusted for score lines 414 with respect to side 212 of housing 74 for locating the liner for a door thickness of one and three-quarters inches. Further, liner 48 can be adjusted to align score lines 416 with side 212 of housing 74 to locate the liner with respect to the housing for a door thickness of two inches.

Since liner 48 can now be precisely adjusted to the desired location relative to housing 74, such adjustment can now be made at the factory rather than the installation site. This eliminates the tedious on-site procedure formerly required.

Occasionally, it is desired to change the hand of door 260. To accomplish this change, lockset 30 has to be shifted from a position adjacent one edge 422 of door 260 to the opposite edge while maintaining the same inside-outside orientation for the door. When this occurs, the door is prepared with the holes as noted above for receipt of the various components of lockset 30. In such preparation, the pair of large diagonal holes are now shifted by ninety degrees. Thus, a liner of prior design which contains only two holes for alignment with the prepared pair of large diagonal holes, cannot be used when the hand of the door is changed because the two holes of the liner will not align with holes formed in the door. For example, assume that liner 36 contained only diagonal holes 362 and 358 for alignment with posts 388 and 390, respectively, and did not contain diagonal holes 356 and 360. When the hand of the door is changed, the pair of large diagonal holes which are formed for the new hand of the door do not align with holes 362 and 358 of liner 36. Thus, in this instance, a first liner with only two holes as just described would be dedicated for one hand of the door. A second liner with two holes shifted ninety degrees from the holes of the first liner is dedicated to the other hand of the door.

As described above, liner 36 is formed with four holes 356, 358, 360 and 362. Diagonal holes 362 and 358 align with holes in door 260 which, as previously noted, receive posts 388 and 390, respectively. This represents one hand of door 260. When it is desired to change the hand of door 260, inside subassembly 32 will remain on the inside face 262 of the door. However, lockset 30 will be relocated to a position on inside face 262 adjacent an edge of door 260 which is opposite edge 266. New holes are formed through door 260 but do not align with holes 362 and 358 of liner 36. However, diagonal holes 356 and 360 of liner 36 will align with the newly formed holes thereby allowing use of the liner for either hand of the door. In this context, liner 36 is a non-handed liner. This eliminates the need for separate liners for opposite hands of a door and thereby eliminates the need for two manufacturing operations and separate storage and coding for two liners.

In general, the above-described embodiment is not to be construed as limiting the breadth of the present invention. Modifications, and other alternative constructions, will be apparent which are within the spirit and scope of the invention as defined in the appended claims.

What is claimed is:

1. A cylindrical lockset comprising a latchbolt, a mechanism for moving the latchbolt between a latched position and an unlatched position, a rotatable cylindrical sleeve operatively engaging said mechanism, an operator secured to said rotatable sleeve, a fixed housing for said mechanism including a threaded sleeve receiving a portion of said rotatable sleeve, a ring shaped spring cassette slidably received by said rotatable sleeve between said threaded sleeve and said operator including a first ring shaped plate, a second ring shaped plate parallel to and axially spaced from said first ring shaped plate, and a coil torsion spring located between said first and second ring shaped plate, means for interconnecting said first ring shaped plate and said threaded sleeve, means for interconnecting said second ring shaped plate and said operator, and said first and second ring shaped plates including means for subjecting said coil torsion spring to in increasing stress as said operator is rotated to move said latchbolt from said latched position to an unlatched position.

2. A cylindrical lockset according to claim 1 wherein said means for interconnecting said first ring shaped plate and said threaded sleeve comprises cooperating key and keyway means on said first ring shaped plate and on said threaded sleeve for releasably connecting said first ring shaped plate to said fixed housing, and wherein said means for interconnecting said second ring shaped plate and said operator comprises cooperating key and keyway means on said second ring shaped plate and on said operator for releasably connecting said second ring shaped plate to said operator.

3. A cylindrical lockset according to claim 2, wherein said second ring shaped plate further comprises means for supporting said first ring shaped plate in parallel, spaced relationship.

4. A cylindrical lockset according to claim 1, wherein said subjecting means comprises first tab means on said first ring shaped plate extending axially towards said second ring shaped plate, and second tab means on said second ring shaped plate extending axially towards said first ring shaped plate, said first and second tab means being selectively radially located so as to be radially adjacent when said operator is at said non-operated position, and said coil torsion spring includes radially extending ends engaging either side of said radially adjacent tab means at said non-operated position.

5. A cylindrical lockset according to claim 4 wherein said first and second tab means each comprise a single tab.

6. A cylindrical lockset comprising a latchbolt, a mechanism for moving said latchbolt between a latched position and an unlatched position, a housing for said mechanism, a threaded sleeve secured to said housing, a liner threadedly mounted on said threaded sleeve, and at least one post secured to said liner and extending rearwardly parallel to said threaded sleeve, each of said posts including a plurality of axially spaced locating marks which can be brought into visual alignment with said housing to define a corresponding number of door thicknesses.

7. A cylindrical lockset according to claim 6, wherein said locating marks are cylindrical grooves defined in each of said posts.

8. A cylindrical clockset according to claim 6, wherein there are two posts including said locating marks.

* * * * *